US006653801B1

(12) United States Patent
Takeda et al.

(10) Patent No.: US 6,653,801 B1
(45) Date of Patent: Nov. 25, 2003

(54) MERCURY-FREE METAL-HALIDE LAMP

(75) Inventors: Mamoru Takeda, Soraku-gun (JP); Makoto Horiuchi, Sakurai (JP); Kiyoshi Takahashi, Neyagawa (JP); Makoto Kai, Katano (JP); Takeshi Saito, Amagasaki (JP); Hideaki Kiryu, Takatsuki (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/554,409

(22) PCT Filed: Sep. 10, 1999

(86) PCT No.: PCT/JP99/04969

§ 371 (c)(1),
(2), (4) Date: May 12, 2000

(87) PCT Pub. No.: WO00/16360

PCT Pub. Date: Mar. 23, 2000

(30) Foreign Application Priority Data

Sep. 16, 1998 (JP) ..... 10-261155
Mar. 11, 1999 (JP) ..... 11-064732
Jul. 30, 1999 (JP) ..... 11-216830

(51) Int. Cl.[7] ..... H05B 41/16

(52) U.S. Cl. ..... 315/246; 315/94; 315/82; 313/637; 313/318.11; 313/39; 313/113

(58) Field of Search ..... 315/246, 77, 82, 315/94; 313/37, 39, 42, 43, 113, 484, 571, 576, 637, 641, 642, 318.08, 318.11

(56) References Cited

U.S. PATENT DOCUMENTS

| | | | | |
|---|---|---|---|---|
| 3,259,777 A | | 7/1966 | Fridrich | 313/184 |
| 3,876,895 A | | 4/1975 | Lake et al. | 313/184 |
| 3,989,970 A | | 11/1976 | Downing | 313/42 |
| 4,340,836 A | | 7/1982 | Bergman et al. | 313/211 |
| 4,594,529 A | | 6/1986 | de Vrijer | 313/571 |
| 4,850,918 A | * | 7/1989 | English et al. | 445/40 |
| 4,874,988 A | * | 10/1989 | English et al. | 313/620 |
| 4,935,668 A | | 6/1990 | Hansler et al. | 315/82 |
| 5,059,865 A | * | 10/1991 | Bergman et al. | 315/82 |
| 5,184,044 A | | 2/1993 | Thomas | 313/638 |
| 5,221,876 A | * | 6/1993 | Bergman et al. | 315/82 |
| 5,789,850 A | * | 8/1998 | Iwafuji et al. | 313/318.08 |
| 5,920,152 A | * | 7/1999 | Yasuda et al. | 313/571 |
| 6,069,456 A | * | 5/2000 | Fromm et al. | 315/248 |
| 2002/0047526 A1 | | 4/2002 | Ishigami et al. | 313/641 |

FOREIGN PATENT DOCUMENTS

| | | |
|---|---|---|
| EP | 0 416 937 A3 | 3/1991 |
| EP | 0 416 937 A2 | 3/1991 |
| EP | 0 587 238 A1 | 9/1993 |
| EP | 0 828 285 A3 | 3/1998 |
| EP | 0 828 285 A2 | 3/1998 |
| EP | 0 883 160 A1 | 12/1998 |
| GB | 1 502 612 A | 3/1978 |
| GB | 2 216 334 A | 10/1989 |
| JP | 49-17471 | 5/1974 |
| JP | 62-10853 | 1/1987 |
| JP | 54-142880 | 7/1989 |
| JP | 10-112289 | 9/1996 |
| JP | 11-86795 | 3/1999 |
| JP | 11-238488 | 8/1999 |
| WO | WO 98/25294 | 6/1998 |

OTHER PUBLICATIONS

"Lightning Engineering" (JP) by Electricity Society, Nov. 20, 1964 pp. 18–19.

* cited by examiner

*Primary Examiner*—Haissa Philogene
(74) *Attorney, Agent, or Firm*—Parkhurst & Wendel, L.L.P.

(57) ABSTRACT

A pair of electrodes (3) are provided in an arc tube (1) I/S is 20 (A/mm$^2$) or less on a condition that an area of a cross section at a tip of the electrodes (3) is S (mm$^2$) and an operating current between the electrodes (3) is I (A). According to this constitution, a long lamp life can be obtained without causing a rise in the lamp voltage and the blackening of the arc tube (1) by the evaporation of the electrodes while operation time becomes longer.

12 Claims, 16 Drawing Sheets

MERCURY-FREE METAL-HALIDE LAMP

TECHNICAL FIELD

The present invention relates to a mercury-free metal-halide lamp comprising no mercury, which is usable for various light sources such as general luminaries, and motor vehicle headlights combined with reflectors and the like.

BACKGROUND ART

A lamp used conventionally for motor vehicle headlights has been principally a halogen lamp comprising a tungsten filament. However, a metal-halide lamp, which is a high-pressure discharge lamp of metal halide, has recently been adopted for the purpose of obtaining a high efficiency and improving a recognition of white lines.

In the above-mentioned conventional metal-halide lamp, rare gas, metal halide (solid matter) and, additionally, mercury are enclosed in an arc tube. Rare gas of these enclosures is enclosed principally in order to facilitate a starting of a lamp and to obtain a high light output immediately after the starting, metal halide is enclosed in order to obtain an appropriate light output during a stable operation, and mercury is enclosed in order to obtain a sufficiently high voltage between the electrodes (amp voltage), which is required for the stable operation of the lamp.

A high voltage between the electrodes can be obtained in the lamp in operation particularly by the enclosure of mercury, and thereby the lamp is operated at a low lamp current. As a result, the heat load of the electrodes (Joule loss) is reduced and the lamp can be operated for a long time up to several thousand hours.

A lamp appropriate for motor vehicle headlights, for instance, disclosed in Japanese Unexamined Patent Publication No. 59-111244, is known as a concrete example of conventional metal-halide lamps. The conventional metal-halide lamp according to the Publication will be described below showing in FIG. 16.

In FIG. 16, 101 indicates an arc tube made of quartz, and 102 at both ends of the arc tube 101 indicates a seal portion. 103 indicates a pair of electrodes made of tungsten, 104 indicates a molybdenum foil, and 105 indicates a lead wire made of molybdenum. The electrodes 103 are connected electrically with an end of the molybdenum foil 104 sealed in the seal portion 102, and additionally, the lead wire 105 is connected electrically with the other end of the molybdenum foil 104.

The tips of the electrodes 103 in the arc tube 101 are disposed so that a distance between the tips, namely, a distance between the electrodes is approximately 4.2 (mm). An internal volume of the arc tube 101 is approximately 0.03 (cc). Approximately 0.7 mg(approximately 1.1 mg/cc per unit internal volume of the arc tube) of mercury 106; approximately 0.3 mg in total (approximately 12.0 mg/cc per unit internal volume of the arc tube) of halide 107 composed of sodium iodide, scandium iodide and thorium iodide; and xenon gas with a pressure of 0.7MPa at room temperature, not shown in FIG. 16, are enclosed inside the arc tube 101.

In the above-mentioned metal-halide lamp, the lamp voltage becomes approximately 70 to 80 V Consequently, for instance, in the case of operating at a lamp power of approximately 35W, the lamp current becomes approximately 0.4 to 0.5A.

Thus, a high lamp voltage is obtained by mercury. As a result, the above mentioned conventional metal-halide lamp can be operated at a low current, and thereby this conventional metal-halide lamp has a long life up to approximately two thousand hours.

As described above, the enclosure of mercury brings the increase of the lamp voltage, and thereby a long lamp life up to several thousand hours is provided for us.

However, on the other hand, the above-mentioned conventional metal-halide lamp has a disadvantage of causing high manufacturing costs frequently because of requiring the step of injecting liquid mercury for manufacturing. Moreover, in recent years, metal-halide lamps comprising no mercury have been desired in consideration of the global environment.

However, if mercury is removed from the above-mentioned conventional metal-halide lamp, the lamp voltage drops to approximately 25 V In this case, the lamp current in operation becomes approximately 1.5 A, which is approximately three times as high as a conventional metal-halide lamp wherein mercury is enclosed. Consequently, the heat load of the electrodes (Joule loss) is increased and the evaporation of the electrode becomes active. Therefore, in a mercury-free lamp having a constitution in which mercury is merely removed from a conventional metal-halide lamp, the problem is that the arc tube is blackened in no more than several tens of hours and reaches the end of its life in a very short time. Moreover, since a distance between the electrodes is increased by the evaporation of the electrodes, the operation of the lamp changes while operation time becomes longer, and additionally, an excessive load is caused on the driver circuit.

Since a complete removal of mercury from a fluorescent lamp reduces efficiency greatly on the current level of technology, an effort to decrease mercury is made; however, no mercury in a fluorescent lamp is not yet achieved. In addition, an effort to intend no mercury in a metal-halide lamp is made, and consequently, an electrodeless discharge lamp comprising no mercury is in the process of being available on the market. Meanwhile, an electrode discharge lamp comprising no mercury is still in the stage of study.

DISCLOSURE OF THE INVENTION

In view of the above-mentioned points, the purpose of the present invention is to provide a mercury-free metal-halide lamp wherein a long lamp life can be obtained without enclosing mercury, and causing a rise in the lamp voltage and the blackening of an arc tube 1 by the evaporation of the electrodes while operation time becomes longer.

That is, it has been conventionally considered by experience that a little lamp current is necessary for making the life longer. However, the same life can not always be obtained at the same current depending on the conditions of specifications and operation of the lamp. The inventors of the present invention have found out through a long study that the important factor for the lamp life is not a value of current but current density, and completed the present invention.

The invention according to claim 1 is:

a mercury-free metal-halide lamp comprising a pair of discharge electrodes in an arc tube, wherein at least a rare gas and a metal halide are enclosed in the arc tube, and I/S is 20 ($A/mm^2$) or less on a condition that an area of a cross section at a tip of the above-mentioned discharge electrodes is S ($mm^2$) and a lamp operating current is I (A).

The invention according to claim 2 is:

a mercury-free metal-halide lamp according to claim 1, wherein the above-mentioned I/S is 15 ($A/mm^2$) or less.

The invention according to claim 3 is:

a mercury-free metal-halide lamp according to claim 1, wherein a temperature at a tip of the above-mentioned discharge electrodes is 3200 K or less.

According to these constitutions, a great rise in the lamp voltage and the blackening of an arc tube by a synergistic effect of a rise in vapor pressure of a metal halide and an increase in a distance between the electrodes, resulting from the evaporation of the electrodes while operation time becomes longer, are restrained, and thereby a long lamp life can be obtained.

The invention according to claim 4 is:

a mercury-free metal-halide lamp according to claim 3, wherein a temperature at a tip of the above-mentioned discharge electrodes is 2500 K or more.

According to this constitution, it is easily possible to start a stable discharge.

The invention according to claim 5 is:

a mercury-free metal-halide lamp according to claim 1 or 3, comprising at least one of a scandium halide and a sodium halide in the above-mentioned arc tube.

The invention according to claim 6 is:

a mercury-free metal-halide lamp according to claim 5, comprising at least one of a indium halide and an yttrium halide in the above-mentioned arc tube.

The invention according to claim 7 is:

a mercury-free metal-halide lamp according to claim 1 or 3, comprising at least a trivalent of indium halide in the above-mentioned arc tube.

The invention according to claim 8 is:

a mercury-free metal-halide lamp according to claim 7, further comprising a thallium halide in the above-mentioned arc tube.

The invention according to claim 9 is:

a mercury-free metal-halide lamp according to claim 7, further comprising at least one of a scandium halide and a sodium halide in the above-mentioned arc tube.

The invention according to claim 10 is:

a mercury-free metal-halide lamp according to claim 8, further comprising at least one of a scandium halide and a sodium halide in the above-mentioned arc tube.

The invention according to claim 11 is:

a mercury-free metal-halide lamp according to claim 7, wherein the above-mentioned trivalent of indium halide is at least one of iodide and bromide.

According to these constitutions, since a high lamp voltage can be obtained, it is possible to make current density a low value easily and thereby to prolong the lamp life certainly.

The invention according to claim 12 is:

a mercury-free metal-halide lamp according to claim 1 or 3, comprising an external tube for maintaining the above-mentioned arc tube, wherein a reflection layer of infrared rays is formed on the above-mentioned external tube.

According to this constitution, since the heat retention of the lamp is raised, the vapor pressure of a metal halide rises easily. Consequently, since the lamp voltage can be raised, it is possible to make current density a low value easily and thereby to prolong the lamp life certainly.

DETAILED DESCRIPTION OF THE PREFERRED EMBODIMENTS

Summary of each Embodiment

First, the summary of each Embodiment will be described below.

The basic principle of the present invention is that it is possible to intend a longer lamp life by making current density lower and reducing the temperature at a tip of the electrodes. In Embodiment 1, the current density and the temperature at a tip of the electrodes for intending a longer lamp life are described.

The first method of making the above-mentioned current density lower is a method of thickening an electrode stick.

The second method of making the current density lower is a method of raising the lamp voltage. Moreover, this method of raising the lamp voltage is a method of determining a distance between the electrodes at a large value, and a method of raising the vapor pressure of an enclosure (luminous substance) in the arc tube. In addition, the above-mentioned method of raising the vapor pressure of an enclosure is a method of using an enclosure with a high vapor pressure (such as a scandium halide and a yttrium halide), and a method of raising the temperature on a wall of the arc tube.

In Embodiment 2, the above-mentioned method of thickening an electrode stick and a method of determining a distance between the electrodes at a large value for raising the lamp voltage are described.

In Embodiments 3 and 4, an enclosure with a high vapor pressure for raising the lamp voltage is described.

In Embodiment 5, a method of raising the temperature on a wall of the arc tube for raising the lamp voltage is described.

Embodiment 1

Figure 1:
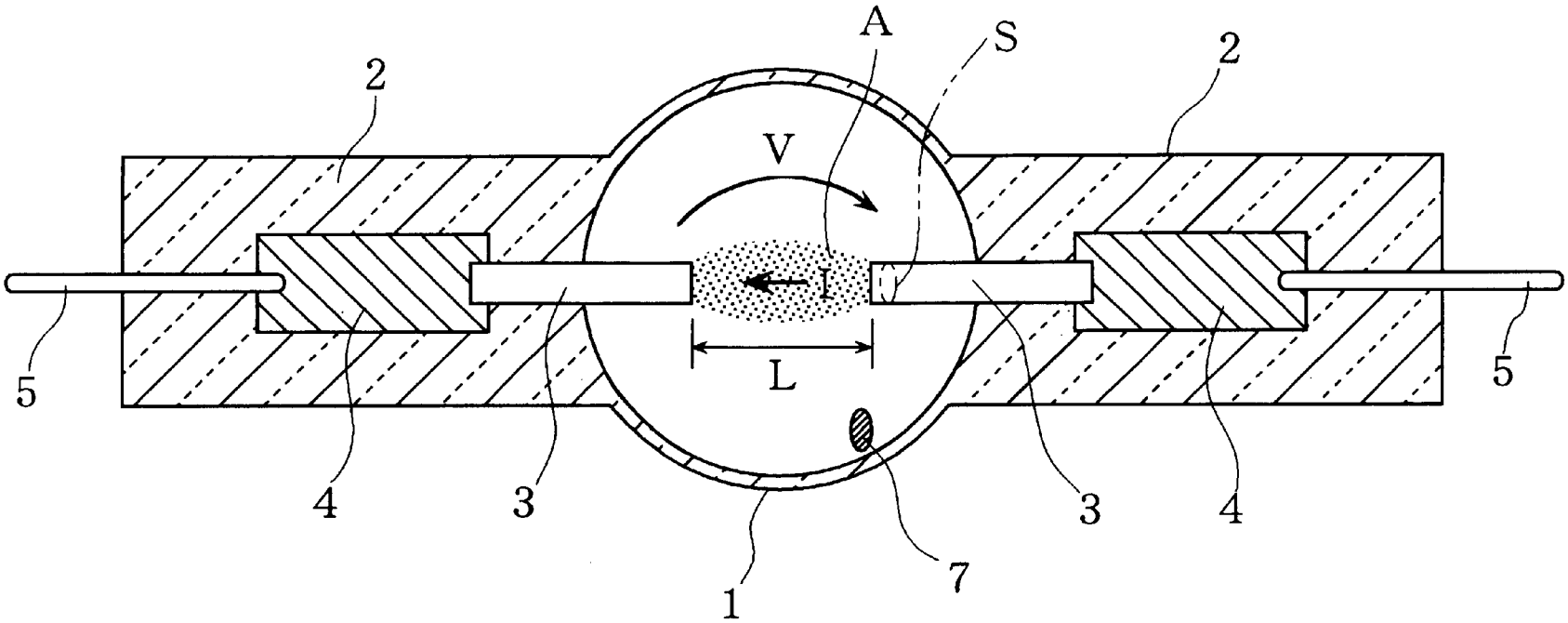
FIG. 1 is a cross sectional view showing a mercury-free metal-halide lamp in Embodiment 1.

Embodiment 1 of the present invention will be described below. FIG. 1 is a cross sectional view showing a mercury-free metal-halide lamp in Embodiment 1 of the present invention.

In FIG. 1, 1 indicates an arc tube made of quartz, and 2 at both ends of the arc tube 1 indicates a seal portion. 3 indicates a pair of electrodes made of tungsten, 4 indicates a molybdenum foil, and 5 indicates a lead wire made of molybdenum. The electrodes 3 are connected electrically with an end of the molybdenum foil 4 sealed in the seal portion 2, and additionally, the lead wire 5 is connected electrically with the other end of the molybdenum foil 4. Halide 7 described later and rare gas not shown in FIG. 1 are enclosed in the arc tube 1. In FIG. 1, an area of a tip of the electrodes 3 (an area of a cross section at a tip in the case of a spherical tip: hereinafter referred to as 'a cross sectional area of the electrodes') is S, a distance between the electrodes 3 is L, a voltage between the electrodes 3 (the lamp voltage) is V, a current between the electrodes 3 (the lamp current) is I, and a discharge arc is A Various lamps with the above-mentioned constitution were manufactured on the condition that, for instance, a distance L between the electrodes is 3.5 to 4.3 mm, a cross sectional area S of the electrodes is 1.169 to 1.327 $mm^2$ (a tip of the electrodes 3 is flat and its diameter $\phi$ is 0.25 to 0.46 mm), and a substance shown below (Table 1) is enclosed as the halide 7. After operating for a hundred consecutive hours in a state of a stable discharge arc A at a lamp power of 35 to 45W, the lamp voltage was measured.

TABLE 1

| luminous substance | diameter of cross section at tip of electrodes (mm) |
|---|---|
| $ScI_3$-NaI-Hg | 0.25 |
| $ScI_3$-NaI | 0.25 |
| $ScI_3$-NaI | 0.31 |
| $ScI_3$-NaI | 0.46 |
| $ScI_3$-NaI-$YI_3$ | 0.25 |
| $ScI_3$-NaI-InI | 0.25 |

The rising rate Rv of the lamp voltage $V_{100}$ after operating for a hundred hours to the lamp voltage $V_0$ immediately after operating was calculated by using the following equation.

$$Rv=(V_{100}-V_0)/V_0 \quad \text{[Equation 1]}$$

Figure 2:
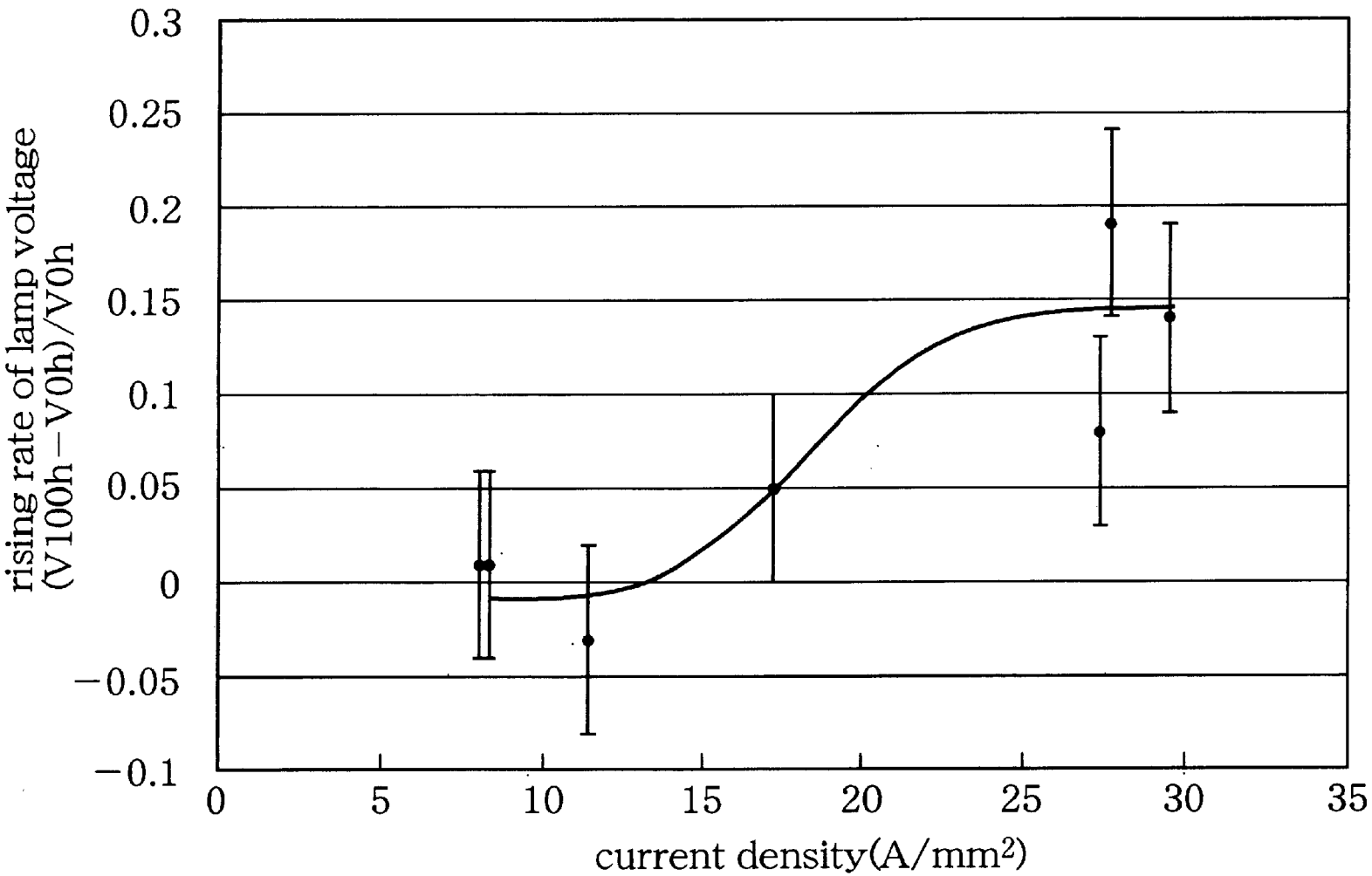
FIG. 2 is a graph showing a relation between the current density and the rising rate of the lamp voltage after operating for a hundred hours in a mercury-free metal-halide lamp of Embodiment 1.

FIG. 2 shows a relation between the rising rate of the lamp voltage and the current density (the lamp current I/a cross sectional area S of the electrodes). An error bar indicates an error of approximately 3% in FIG. 2. As shown in FIG. 2, the rising rate of the lamp voltage increases extremely when the current density is above approximately 20 $A/mm^2$. In this case (such as 30 $A/mm^2$), a part of the electrodes 3 evaporate and the rest of them are deformed into a shape of folds. The blackening of the arc tube 1 is caused by the above-mentioned evaporation and the maintenance rate of the luminous flux is reduced greatly. When the current density is high, the arc tends to be unstable. Meanwhile, when the current density is below approximately 20 $A/mm^2$, the rising rate Rv of the lamp voltage becomes below approximately 0.1, which satisfies a general condition for non-defective unit. Furthermore, when the current density is below approximately 10 $A/mm^2$, the rising rate of the lamp voltage can be decreased greatly. In these cases (such as 8 $A/mm^2$), the electrodes 3 are scarcely deformed and the luminous flux is not reduced by the blackening.

The reasons why the rising rate of the lamp voltage increases abruptly according to a rise in the current density as described above are as follows.

The lamp voltage Vla is represented generally in the following equation.

$$Vla \propto N^{1/2} \times L \quad \text{[Equation 2]}$$

In the Equation, N indicates the particle density in a lamp and L indicates a distance between the electrodes.

Figure 3:
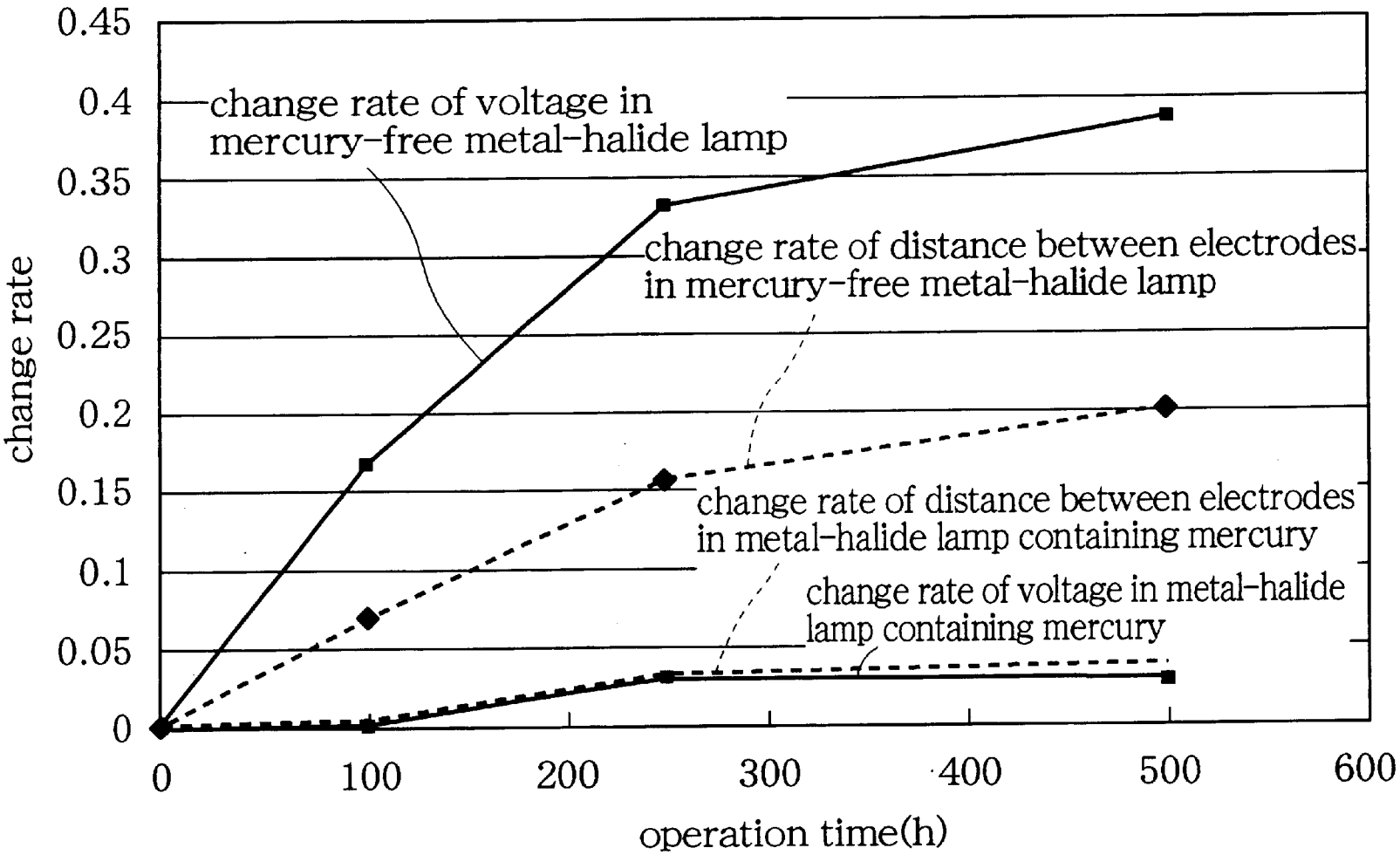
FIG. 3 is a graph showing a relation among the operation time and the change rate of a distance between the electrodes and the change rate of the lamp voltage in a mercury-free metal-halide lamp of Embodiment 1.
Figure 4:
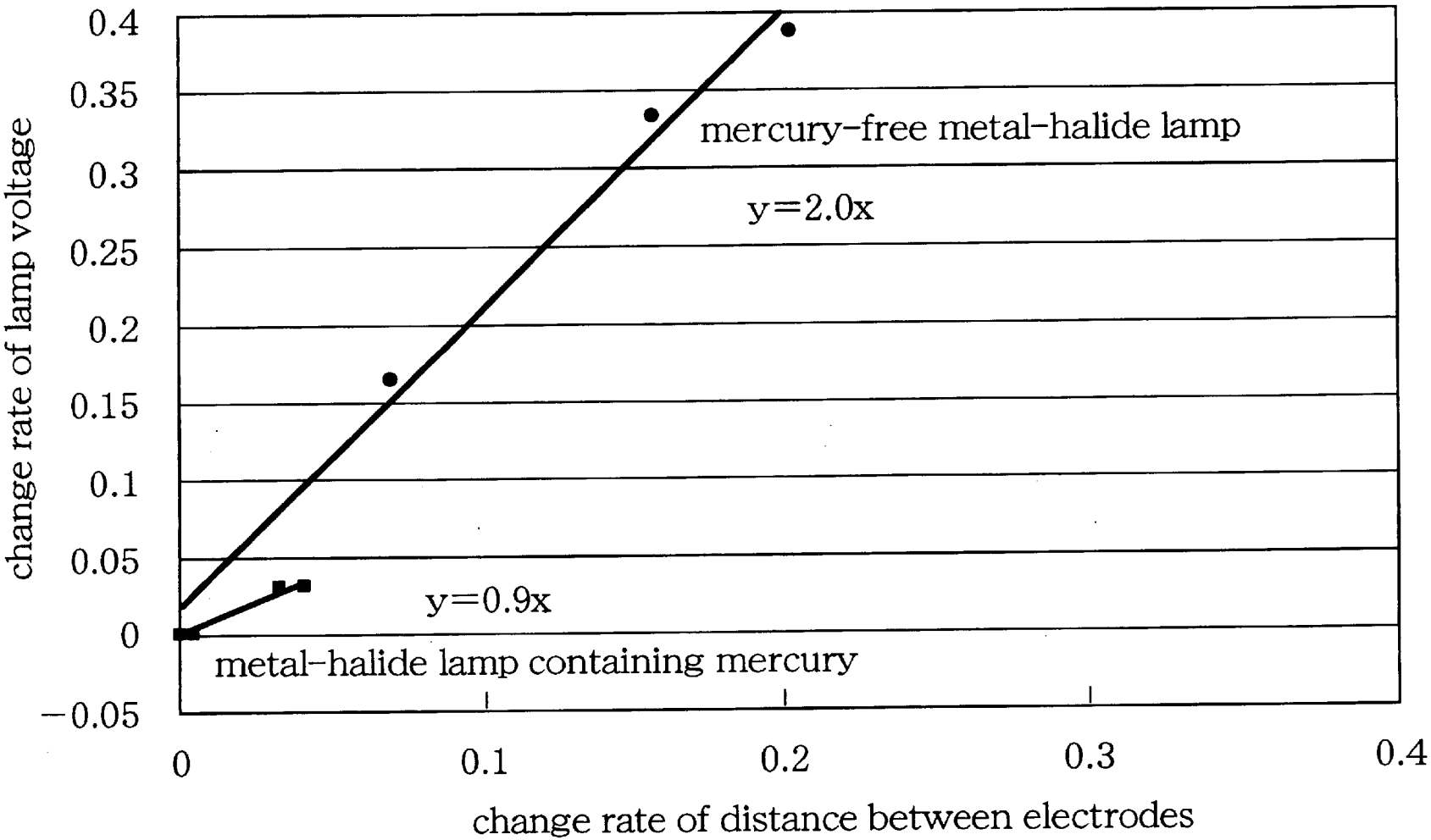
FIG. 4 is a graph showing a correlation between the change rate of a distance between the electrodes and the change rate of the lamp voltage in a mercury-free metal-halide lamp of Embodiment 1.

After operating the above-mentioned mercury-free lamp at a current density of approximately 25 $A/mm^2$ and a conventional lamp containing mercury at a current density of approximately 8 $A/mm^2$, the lamp voltage Vla and a distance L between the electrodes were measured while operation time becomes longer. Next, the change rates of the voltage Vla and the distance L to the corresponding value immediately after operating were calculated, and the result was shown in FIG. 3. That is, in the case of a lamp containing mercury, the change rate of the lamp voltage Vla and the change rate of a distance L between the electrodes increase slightly while operation time becomes longer, and on the other hand, in the case of a mercury-free lamp, both increase greatly. As regards a relation between the change rate of the lamp voltage Vla and the change rate of a distance L between the electrodes, the gradient is approximately 0.9 in a lamp containing mercury as shown in FIG. 4, in other words, the change rate of the lamp voltage Vla and the change rate of a distance L between the electrodes increase in approximately the same degree. Meanwhile, the gradient is approximately 2 in a mercury-free lamp, and the change rate of the lamp voltage Vla increases more than the change rate of a distance L between the electrodes.

The reason why the change rate of a distance L between the electrodes increases slightly in a lamp containing mercury as described above is that the electrodes 3 scarcely evaporate. The reason why the change rate of the lamp voltage Vla and the change rate of a distance L between the electrodes increase in approximately the same degree is that N in Equation 2 scarcely changes since all of the enclosed mercury becomes mercury vapor (that is, L in the above-mentioned Equation 2 changes principally). Meanwhile, the reason why the change rate of a distance L between the electrodes increases greatly in a mercury-free lamp is that the electrodes 3 evaporate actively. The reason why the change rate of the lamp voltage Vla increases more greatly than the change rate of a distance L between the electrodes is that, according to the evaporation of the electrodes 3, a distance L between the electrodes increases and simultaneously the vapor pressure of a metal halide rises (that is, both L and N in the above-mentioned Equation 2 change). In other words, it is considered that when a distance L between the electrodes increases, the temperature on a wall of the arc tube 1 rises, and the vapor pressure of a metal halide rises. When the spectrum was observed actually, the spectrum of metal was observed to change.

Accordingly, as described above, the higher the current density is, the more abruptly the lamp voltage increases and the more remarkable a reduction in the life by the blackening of the arc tube 1 becomes. Meanwhile, the current density is determined at a value below 20 A/mm$^2$, more preferably, 10 A/mm$^2$, and thereby it is possible to restrain a rise in the lamp voltage greatly and to obtain a long lamp life.

Next, an example of using the temperature at a tip of the electrodes as an index of the above-mentioned current density is described. That is, the higher the temperature at a tip of the electrodes is, the more the evaporation of the electrodes is promoted. Therefore, a lower temperature at a tip of the electrodes makes it possible to obtain a lower rising rate of the lamp voltage and a longer lamp life. Generally, it is very difficult to measure the temperature of the electrodes in a metal-halide lamp directly. However, by means of using a method which the inventors of the present invention disclose in Japanese Unexamined Patent Publication No. 4–99, it is possible to remove the noise resulting from the spectrum of metal and to facilitate a measurement with a very high precision.

More specifically, first, after measuring luminances L1 and L2 of two lights with wavelengths λ1 and λ2 (for instance, λ1=613 nm, λ2=807 nm), a ratio R of the luminance L1 to the luminance L2 is calculated.

$$R=L1(\lambda 1)/L2(\lambda 2) \quad \text{[Equation 3]}$$

Next, the temperature T of the electrodes is calculated by using the above-mentioned luminance ratio R.

$$T=C(1/\lambda 1-1/\lambda 2)/\ln(R\times\lambda 1^5/\lambda 2^5) \quad \text{[Equation 4]}$$

In the Equation, C=0.0014388[m·K]

Figure 5:
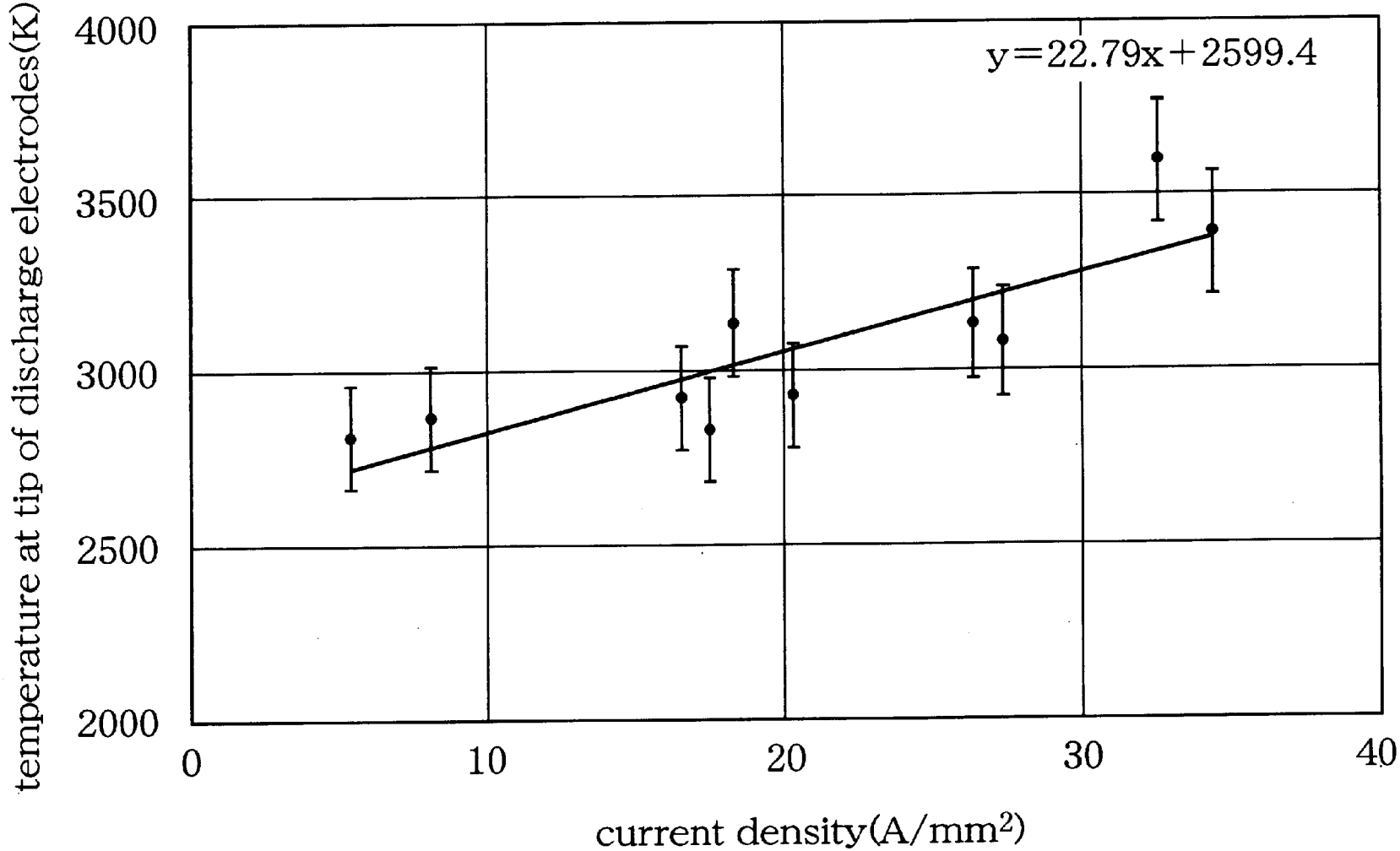
FIG. 5 is a graph showing a relation between the current density and the temperature at a tip of the electrodes in a mercury-free metal-halide lamp of Embodiment 1.

FIG. 5 shows a relation between the temperature at a tip of the electrodes thus calculated and the current density. As shown in FIG. 5, the temperature at a tip of the electrodes corresponding to a current density of 20 A/mm$^2$is 3200 K, and the lamp can have a long life by determining the temperature at a value below 3200 K. It is preferable to determine the temperature at a value above 2500 K for starting a stable discharge.

Embodiment 2

A concrete method of making the current density lower is described.

The current density can be made lower by thickening an electrode stick. More specifically, for instance, the lamp current is 0.5 A in the case of a rated power of 35W and a lamp voltage of 70 V. Then, the current density can be made 20 A/mm$^2$ or less by determining a cross sectional area of the electrodes at a value above 0.025 mm$^2$(the diameter is approximately 0.18 mm in the case of a circular cross section). However, if an electrode stick is thickened too much, the capacity of the arc tube to resist pressure is reduced in inverse proportion to the diameter of an electrode stick. That is, a stress near a gap at a junction of the arc tube to the electrode stick becomes larger. Therefore, like a lamp for motor vehicles, when the inside of the arc tube has a high pressure (such as 10MPa in operating), it is preferable to make the diameter of an electrode stick smaller in terms of the mechanical strength. In addition, it is preferable to make the diameter of an electrode stick smaller in order to shorten time for the starting of the luminous flux in starting the operation.

The lamp voltage is raised by making a distance between the electrodes larger, and thereby the current density can be made lower. For instance, when a distance between the electrodes of approximately 4 mm in a conventional normal lamp is increased to approximately 5 mm, the lamp voltage can be raised by approximately 25%. Therefore, it becomes easy to make the current density lower. However, it is preferable not to make a distance between the electrodes too large in terms of the size of a light source when the lamp is used with reflectors, such as motor vehicle headlights.

Embodiment 3

An enclosure, which can raise the lamp voltage by raising vapor pressure, is described.

Figure 6:
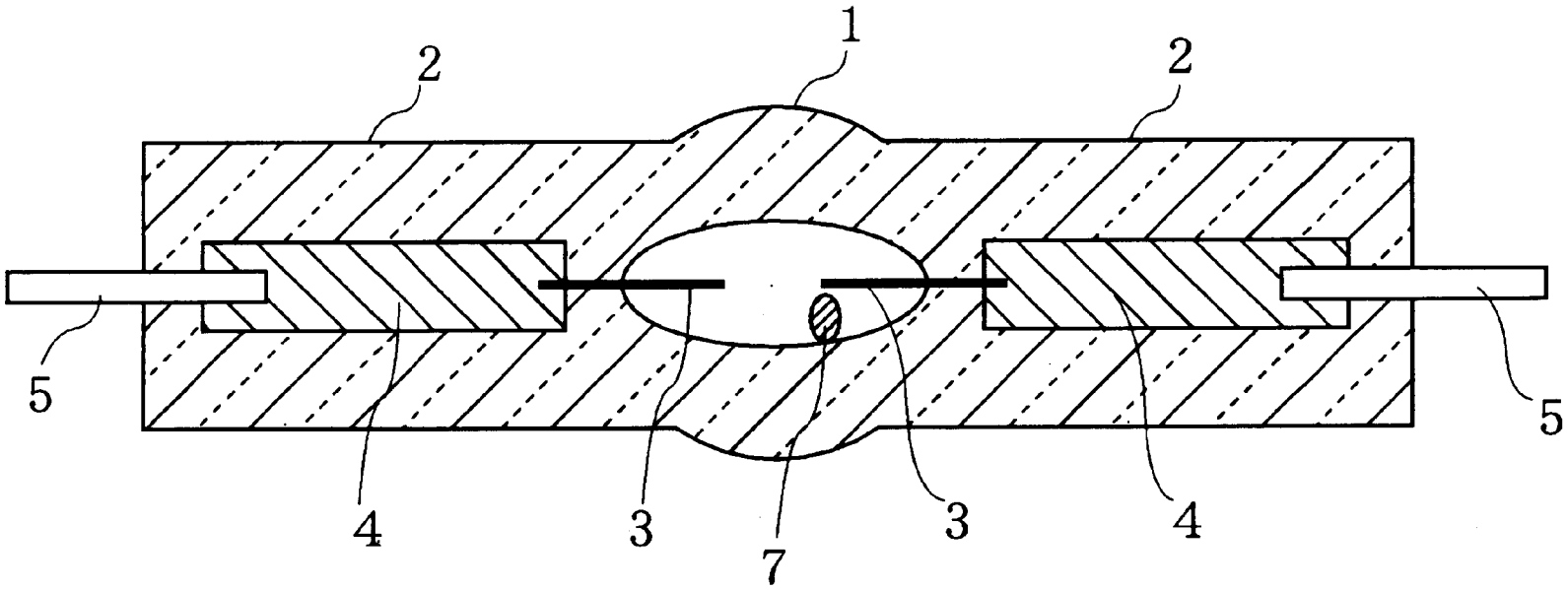
FIG. 6 is a cross sectional view showing a mercury-free metal-halide lamp in Embodiments 3 and 4.

Embodiment 3 of the present invention will be described below. FIG. 6 is a cross sectional view showing a mercury-free metal-halide lamp in Embodiment 3 of the present invention.

In FIG. 6, 1 indicates an arc tube made of quartz, and 2 at both ends of the arc tube 1 indicates a seal portion. 3 indicates a pair of electrodes made of tungsten, 4 indicates a molybdenum foil, and 5 indicates a lead wire made of molybdenum. The electrodes 3 are connected electrically with an end of the molybdenum foil 4 sealed in the seal portion 2, and additionally, the lead wire 5 is connected electrically with the other end of the molybdenum foil 4.

The tips of the electrodes 3 in the arc tube 1 are disposed so that a distance between the tips, namely, a distance between the electrodes is approximately 4.2 (mm).

An internal volume of the arc tube 1 is approximately 0.025 (cc). Halide 7 composed of approximately 0.2 mg of a trivalent of indium iodide ($InI_3$) (approximately 8.0 mg/cc per unit internal volume of the arc tube), approximately 0.19 mg of scandium iodide (approximately 8.0 mg/cc per unit internal volume of the arc tube), and approximately 0.16 mg of sodium iodide (approximately 6.4 mg/cc per unit internal volume of the arc tube); and xenon gas with a pressure of approximately 0.7MPa at room temperature, not shown in FIG. 6, are enclosed inside the arc tube 1.

The noticeable characteristic of the constitution of a metal-halide lamp in Embodiment 3, as compared with the constitution of a conventional metal-halide lamp, is that the constitution comprises no mercury, and the enclosed indium iodide is a trivalent of indium iodide ($InI_3$).

The notable fact of a mercury-free metal-halide lamp in Embodiment 3, wherein a trivalent of indium iodide ($InI_3$) is enclosed, is that the lamp is operated at a very high lamp voltage despite no mercury. For instance, the lamp voltage of the lamp in Embodiment 3 is approximately 55 V in the case of operating at a lamp power of 45W, and the lamp voltage is approximately 50 V in the case of operating at a lamp power of 35W. When a lamp wherein a trivalent of indium iodide ($InI_3$) is removed from the lamp in Embodiment 3 is operated at a lamp power of 25 to 50W, the lamp voltage is no more than approximately 27 V. In addition, when a lamp, wherein a monovalent of indium iodide (InI) is substituted for a trivalent of indium iodide ($InI_3$) in a mercury-free metal-halide lamp of Embodiment 3, is operated at a lamp power of 35 W, the lamp voltage is approximately 45 V, which does not reach the lamp voltage of the lamp in Embodiment 3.

Thus, since a high lamp voltage is obtained by enclosing $InI_3$, the lamp in Embodiment 3 can be operated for several hundred hours or more without the blackening of the arc tube, namely, any substantial change.

Since a high lamp voltage can be obtained as described above, it is possible to make current density a value below 20 A/mm$^2$ easily and to prolong the lamp life certainly. More specifically, for instance, when a diameter of the electrodes 3 is. 0.25 mm and the lamp power is 35W, it is preferred to determine the enclosed amount of InI3 and the like so that the lamp voltage is approximately 35.7 V or more.

Figure 7:
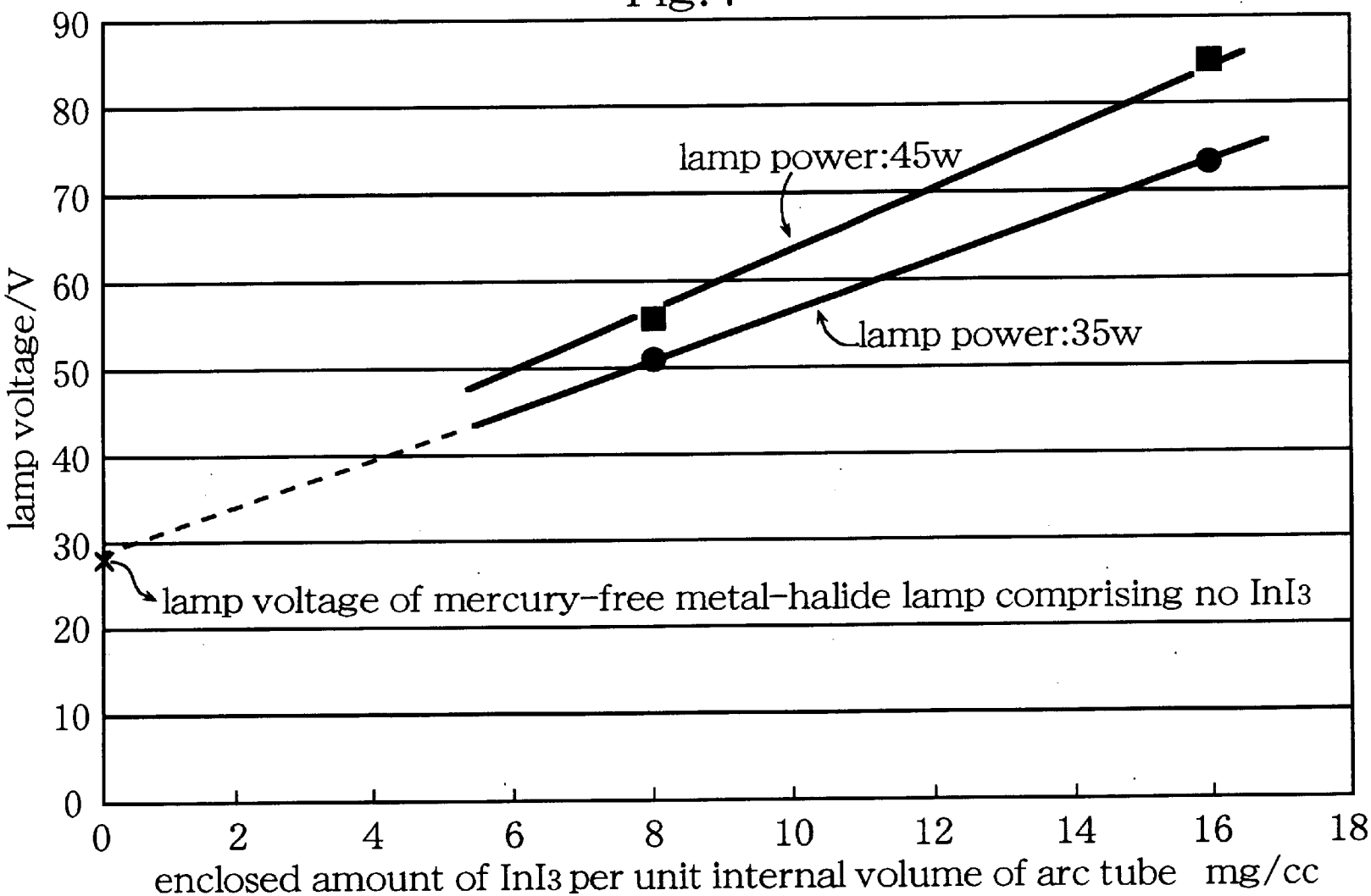
FIG. 7 is a graph showing a relation between the enclosed amount of a trivalent of indium iodide ($InI_3$) and the lamp voltage in a mercury-free metal-halide lamp of Embodiment 3.

A mercury-free metal-halide lamp, wherein approximately 0.2 mg of a trivalent of indium iodide ($InI_3$) (approximately 8.0 mg/cc per unit internal volume of the arc tube) is enclosed, is described in the above-mentioned example. As shown in FIG. 7, it is found that when the enclosed amount of a trivalent of indium iodide ($InI_3$) is increased, an even higher lamp voltage is obtained, therefore the lamp voltage affects the life advantageously. FIG. 7 is a graph showing a relation between the lamp voltage and the enclosed amount of a trivalent of indium iodide ($InI_3$) in the case of operating at a lamp power of 35W or 45W while increasing the enclosed amount of a trivalent of indium iodide ($InI_3$) in a mercury-free metal-halide lamp of Embodiment 3. More enclosed amount of a trivalent of indium iodide ($InI_3$) brings higher lamp voltage.

An effect of a rise in the lamp voltage by an increase in the enclosed amount of a trivalent of indium iodide ($InI_3$) is obtained regardless of such other factors as the lamp power, a distance between the electrodes, an internal volume of the arc tube 1, the enclosed pressure of the Xe gas, the amount of scandium iodide and sodium iodide, and the kind and the amount of other halides enclosed with the a trivalent of indium iodide ($InI_3$).

Figure 8:
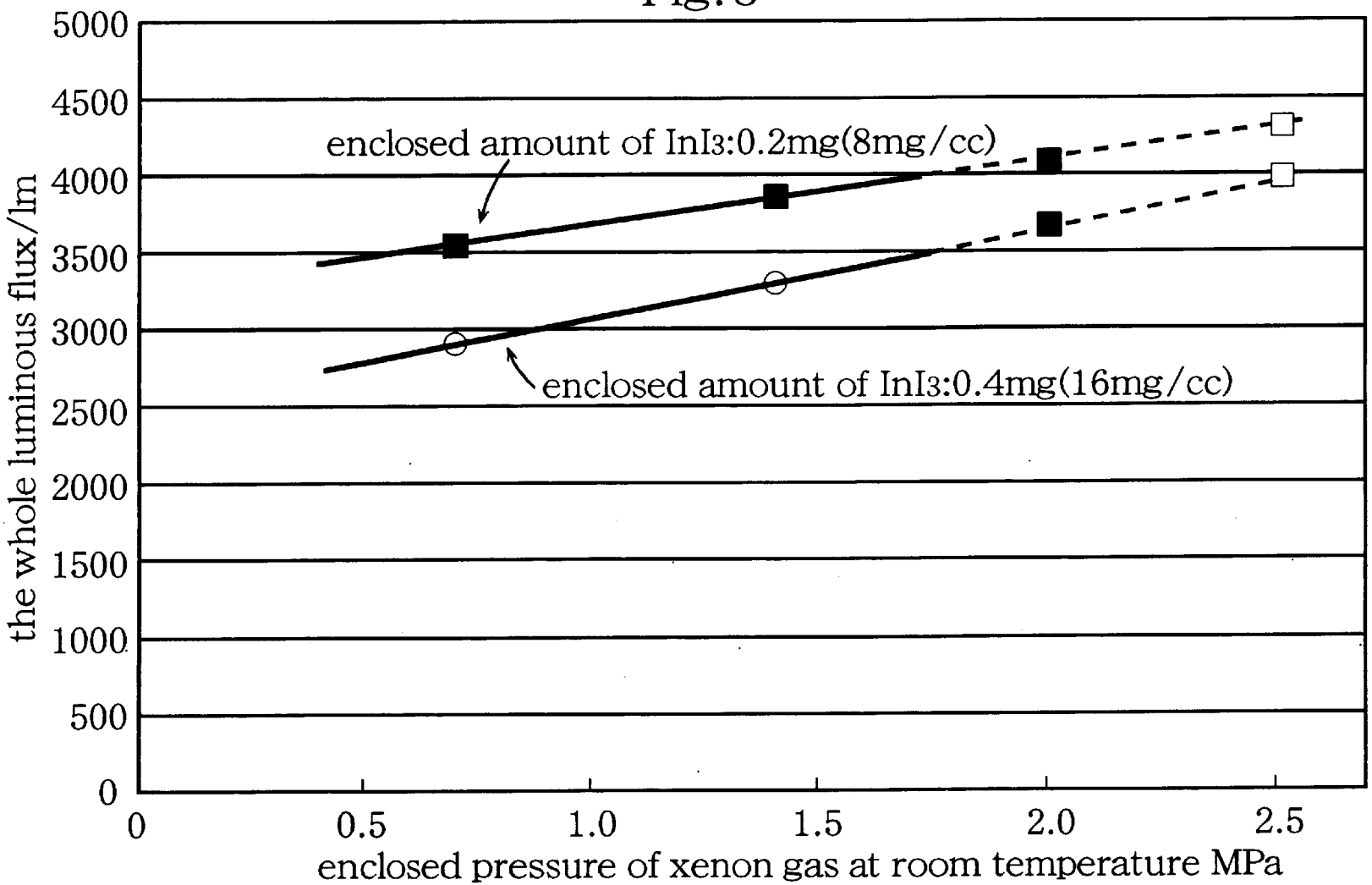
FIG. 8 is a graph showing a relation between the enclosed pressure of xenon gas and the whole luminous flux in a mercury-free metal-halide lamp of Embodiment 3.

The lamp, wherein xenon gas with a pressure of approximately 0.7MPa=700 k Pa at room temperature is enclosed, is described in the above-mentioned example. As shown in FIG. 8, when xenon gas with a higher pressure is enclosed, the whole luminous flux increases approximately linearly. FIG. 8 is a graph showing a relation, under a parameter of the enclosed amount of a trivalent of indium iodide ($InI_3$), between the enclosed pressure (an equivalent at room temperature) of xenon gas and the whole luminous flux in a mercury-free metal-halide lamp of Embodiment 3, which is operated at a lamp power of 45W. The notable fact of a mercury-free metal-halide lamp in Embodiment 3, wherein a trivalent of indium iodide ($InI_3$) is enclosed, is that a rise in temperature at the hotspot (an area with the highest temperature: the top outside of the arc tube 1 in the case of operating the arc tube 1 while maintaining horizontally) of the arc tube 1 by an increase in the enclosed pressure of xenon gas is negligibly small, therefore there is little possibility of an expansion of the arc tube 1 by an increase in the enclosed pressure of xenon gas.

As described above, a mercury-free metal-halide lamp in Embodiment 3, wherein at least xenon gas and a trivalent of indium iodide ($InI_3$) are enclosed in the arc tube 1, has such a characteristic that when the enclosed pressure of xenon gas is increased, the whole luminous flux increases with little rise in temperature at the hotspot; and when the enclosed amount of a trivalent of indium iodide ($InI_3$) is increased, the lamp voltage increases. These effects are obtained regardless of such other factors as the lamp power, a distance between the electrodes, an internal volume of the arc tube 1, the amount of scandium iodide and sodium iodide, and the kind and the amount of other halides enclosed with the trivalent of indium iodide ($InI_3$).

The enclosed pressure of xenon gas is described below. In order to obtain a lamp for practical use, it is preferable to determine an upper limit of the enclosed pressure of xenon gas at approximately 2.5 M Pa (an equivalent at room temperature) in a mercury-free metal-halide lamp of Embodiment 3. The reason is that if xenon gas with a pressure above approximately 2.5MPa is enclosed in a mercury-free metal-halide lamp of Embodiment 3, it is not preferable that there is a higher possibility that the enclosures inside the arc tube 1 leak in operation near a connection portion between the electrodes 3 and the molybdenum foil 4. More preferably, the upper limit of the enclosed pressure of xenon gas is approximately 2.0MPa. Meanwhile, its appropriate lower limit is approximately 5 to 20 kPa, which facilitates a starting of the lamp. However, more preferably, the lower limit is approximately 0.1MPa when a mercury-free metal-halide lamp in the present invention is used as a light source for motor vehicle headlights wherein a starting of light is required in a short time.

Figure 9:
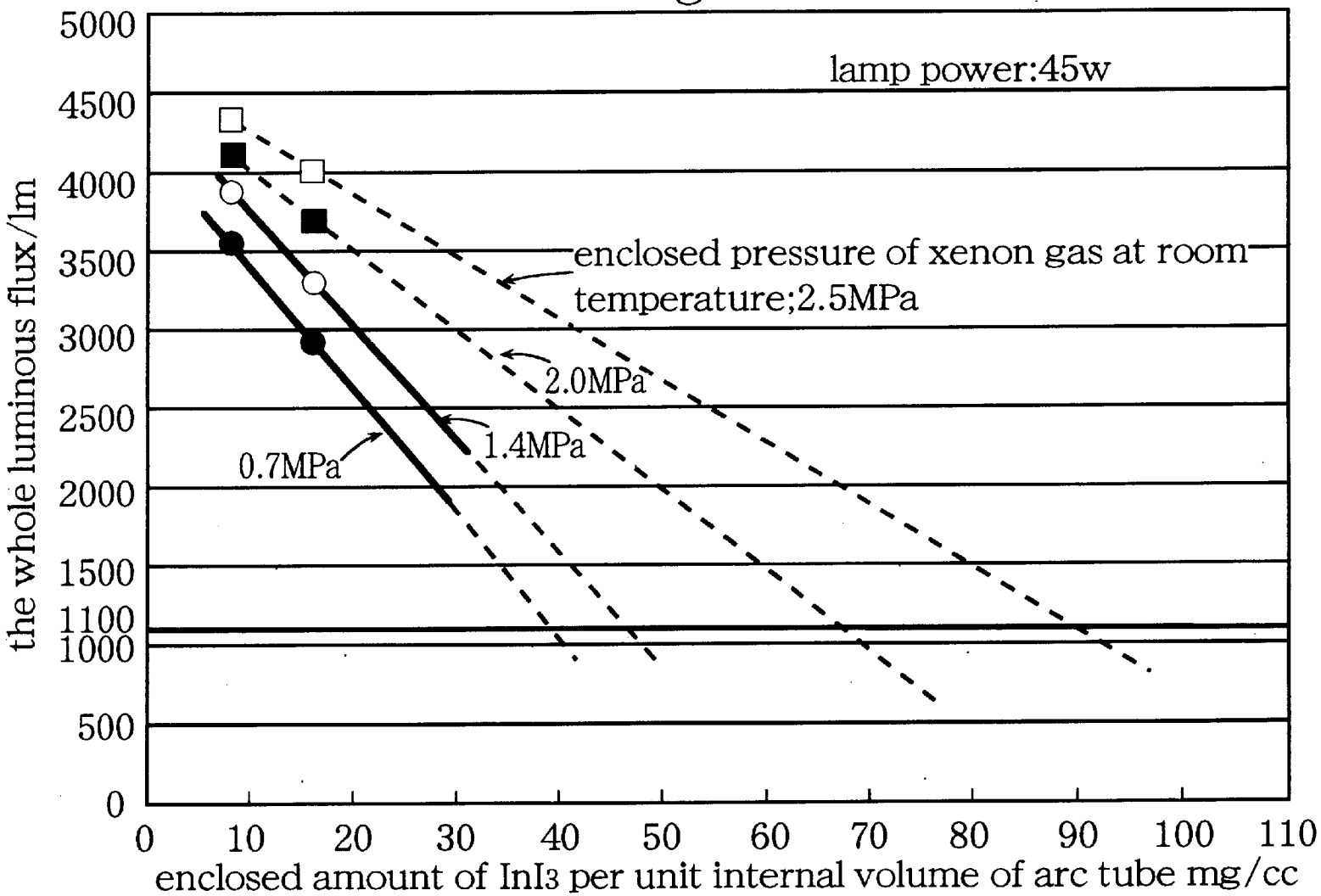
FIG. 9 is a graph showing a relation between the enclosed amount of a trivalent of indium iodide ($InI_3$) and the whole luminous flux in a mercury-free metal-halide lamp of Embodiment 3, which is operated at a lamp power of 45W.

Next, the enclosed amount of a trivalent of indium iodide ($InI_3$) and the luminous flux are described. In a mercury-free metal-halide lamp in the present invention, more enclosed amount of a trivalent of indium iodide ($InI_3$) brings higher lamp voltage, and thereby the lamp voltage is to the advantage of the life. When a mercury-free lamp in Embodiment 3 is used as a light source for motor vehicle headlights, it is preferable to determine the enclosed amount of a trivalent of indium iodide ($InI_3$) at a value below approximately 90.0 mg/cc per unit internal volume of the arc tube. The reason is as follows:

That is, the whole luminous flux of approximately 1100 (1 m) is obtained at a consumption power of 55W in a halogen lamp used frequently for motor vehicle headlights nowadays. Meanwhile, in a lamp in the present invention, as shown in FIG. 9, when the enclosed amount of a trivalent of indium iodide ($InI_3$)is determined at a value below approximately 90.0 mg/cc per unit internal volume of the arc tube, more luminous flux than a conventional halogen lamp is obtained at a consumption power of merely 45W, whereby a more economical lamp is obtained. FIG. 9 is a graph showing a relation, under a parameter of the enclosed pressure (an equivalent at room temperature) of xenon gas, between the whole luminous flux and the enclosed amount of a trivalent of indium iodide ($InI_3$) in a mercury-free metal-halide lamp of Embodiment 3, which is operated at a lamp power of 45W. As shown in FIG. 9, when the enclosed pressure of xenon gas is 2.5 MPa (an equivalent at room temperature), the maximum of allowable values in a mercury-free lamp of Embodiment 3, the luminous flux of approximately 1100 (1 m) or more is obtained on the condition that the enclosed amount of a trivalent of indium iodide ($InI_3$) is approximately 90.0 mg/cc or less per unit internal volume of the arc tube. When the enclosed pressure of xenon gas is lower than 2.5MPa, for instance, 2.0MPa (an equivalent at room temperature), the preferable maximum of allowable values in a mercury-free lamp of Embodiment 3, an appropriate upper limit of the enclosed amount of a trivalent of indium iodide ($InI_3$)for obtaining the luminous flux of approximately 1100 (1 m) or more is approximately 70.0 mg/cc per unit internal volume of the arc tube in a mercury-free metal-halide lamp in the present invention. That is, when the enclosed pressure of xenon gas is 2.0MPa, the luminous flux of approximately 1100 (1 m) or more is obtained on the condition that the enclosed amount is approximately 70.0 mg/cc or less per unit internal volume of the arc tube, whereby a more economical lamp than a conventional halogen lamp is obtained.

Figure 10:
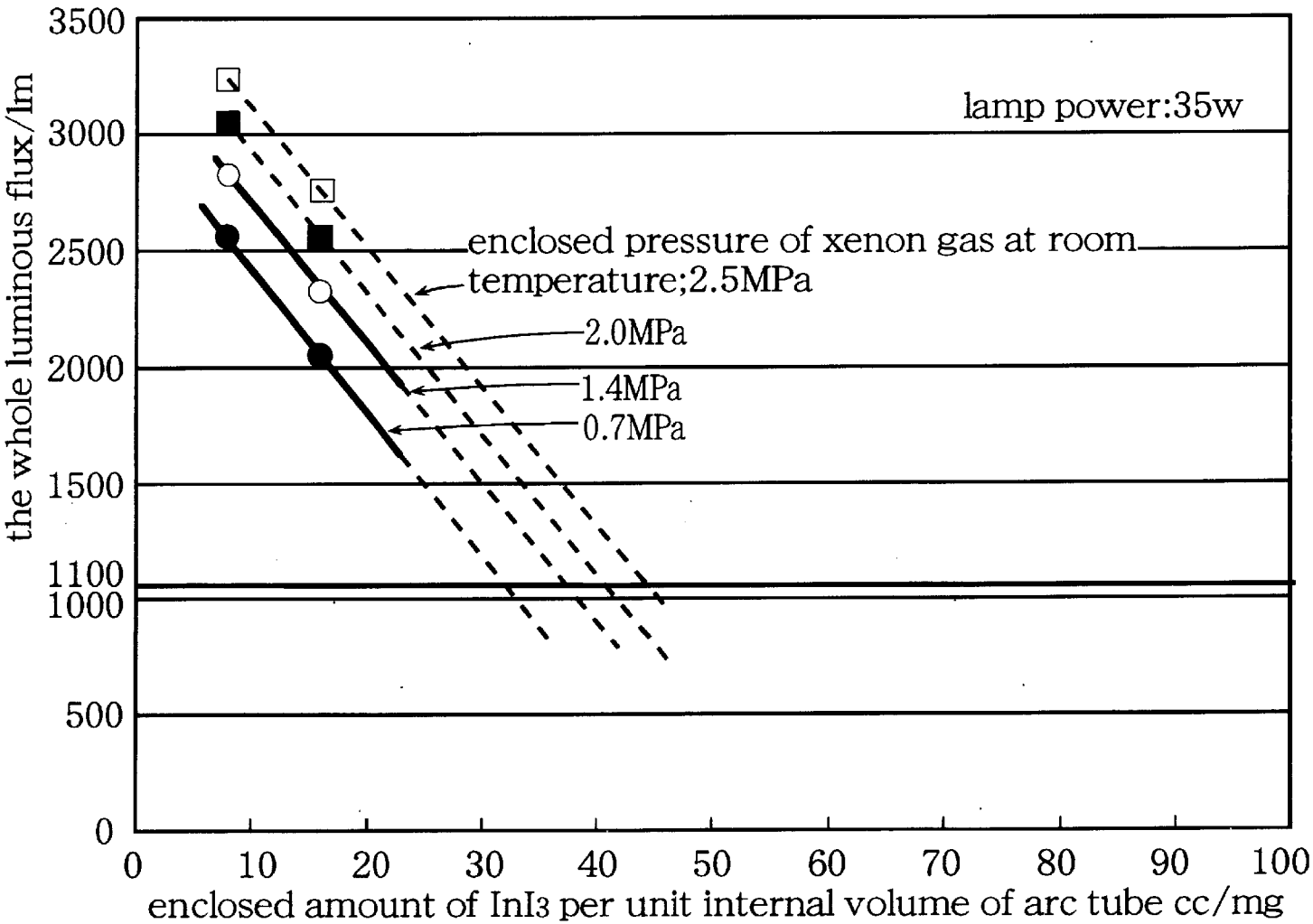
FIG. 10 is a graph showing a relation between the enclosed amount of a trivalent of indium iodide ($InI_3$) and the whole luminous flux in a mercury-free metal-halide lamp of Embodiment 3, which is operated at a lamp power of 35W.

Similarly, FIG. 10 is a graph showing a relation, under a parameter of the enclosed pressure (an equivalent at room temperature) of xenon gas, between the whole luminous flux and the enclosed amount of a trivalent of indium iodide ($InI_3$) in a mercury-free metal-halide lamp of Embodiment 3, which is operated at a lamp power of 35W. When the enclosed amount of a trivalent of indium iodide ($InI_3$)is determined at a value below approximately 50.0 mg/cc per unit internal volume of the arc tube, more luminous flux than a conventional halogen lamp is obtained at a consumption power of merely 35W, whereby a more economical lamp is obtained. When the enclosed pressure of xenon gas is 2.5MPa (an equivalent at room temperature), the luminous flux of approximately 1100 (1 m) or more is obtained on the condition that the enclosed amount of a trivalent of indium iodide ($InI_3$)is approximately 50.0 mg/cc or less per unit internal volume of the arc tube. When the enclosed pressure of xenon gas is lower, for instance, 2.0MPa (an equivalent at room temperature), an appropriate upper limit of the enclosed amount of a trivalent of indium iodide ($InI_3$) is approximately 40.0 mg/cc per unit internal volume of the arc tube. That is, the luminous flux of approximately 1100 (1 m) or more is obtained on the condition that the enclosed amount is approximately 40.0 mg/cc or less per unit internal volume of the arc tube, whereby a more economical lamp than a conventional halogen lamp is obtained.

As described above, in a constitution of a mercury-free metal-halide lamp in the present invention, when xenon gas with an appropriate pressure below an upper limit of 2.5MPa is enclosed and a trivalent of indium iodide ($InI_3$) with an appropriate amount below an upper limit of approximately 90.0 mg/cc per unit internal volume of the arc tube is enclosed, it is possible to obtain a mercury-free metal-halide lamp most appropriate as a light source for motor vehicle headlights, wherein, in the case of operating at a lamp power above approximately 25W, there is no possibility of breaking the airtightness in the arc tube 1; a high lamp voltage is obtained, and thereby the lamp has a long life; and more luminous flux than a halogen lamp occurs.

As regards a lamp power, when a mercury-free lamp in Embodiment 3 is operated at a higher lamp power, more luminous flux is obtained. However, an upper limit of a consumption power of a mercury-free lamp in Embodiment 3 is actually approximately 55W if the lamp is used for motor vehicle headlights. The reason is that an operation in a range above a consumption power of a conventional halogen lamp is uneconomical and not preferable.

Next, the light color of a mercury-free metal-halide lamp in Embodiment 3 is described. In a mercury-free metal-halide lamp in Embodiment 3, when xenon gas with an appropriate pressure below an upper limit of 2.5MPa is enclosed and a trivalent of indium iodide ($InI_3$) with an appropriate amount below an upper limit of approximately 90.0 mg/cc per unit internal volume of the arc tube is enclosed, it is confirmed that the light color of a mercury-free lamp in Embodiment 3, in the case of operating at a lamp power of approximately 25 to 55W, is in a chromaticity range of the white light source specified in HID light sources for motor vehicle headlights (JEL 215) by the Japan Electrical Lamp Manufacturers Association. That is, by means of determining the kind and the amount of the enclosures comprising a trivalent of indium iodide ($InI_3$) and a rated power as described above, a chromaticity coordinate of an emitted light of the lamp can be in a chromaticity range of the following equations in a CIE1931 x,y chromaticity diagram:

$x \geqq 0.310$, $x \leqq 0.500$, $y \leqq 0.150+0.640x$, $y \leqq 0.440$, $y \geqq 0.050+0.750x$, and $y \geqq 0.382$ (in the case where $x \geqq 0.44$).

Accordingly, a mercury-free metal-halide lamp in Embodiment 3 is completely usable as a light source for motor vehicle headlights within the above-mentioned limited range of the enclosed pressure of xenon gas, the enclosed amount of a trivalent of indium iodide ($InI_3$), and a lamp power.

Embodiment 4

Embodiment 4 of the present invention will be described below. The structural constitution of this lamp is the same as the above-mentioned lamp of Embodiment 3 shown in FIG. 6, and this lamp differs from the above-mentioned lamp of Embodiment 3 in the kind of enclosed halide 7, and approximately 1.4M Pa (an equivalent at room temperature) of the enclosed pressure of xenon gas. That is, the halide 7 is composed of approximately 0. 1 mg of a trivalent of indium iodide ($InI_3$) (approximately 4.0 mg/cc per unit internal volume of the arc tube), approximately 0.1 mg of thallium iodide TlI (approximately 4.0 mg/cc per unit internal volume of the arc tube), approximately 0.19 mg of scandium iodide (approximately 8.0 mg/cc per unit internal volume of the arc tube), and approximately 0.16 mg of sodium iodide (approximately 6.4 mg/cc per unit internal volume of the arc tube).

The noticeable characteristic of the constitution of a metal-halide lamp in Embodiment 4, as compared with the constitution of a conventional metal-halide lamp, is that, like Embodiment 3, the constitution comprises no mercury, and the enclosed indium iodide is a trivalent of indium iodide ($InI_3$), and additionally thallium iodide is enclosed.

Figure 11:
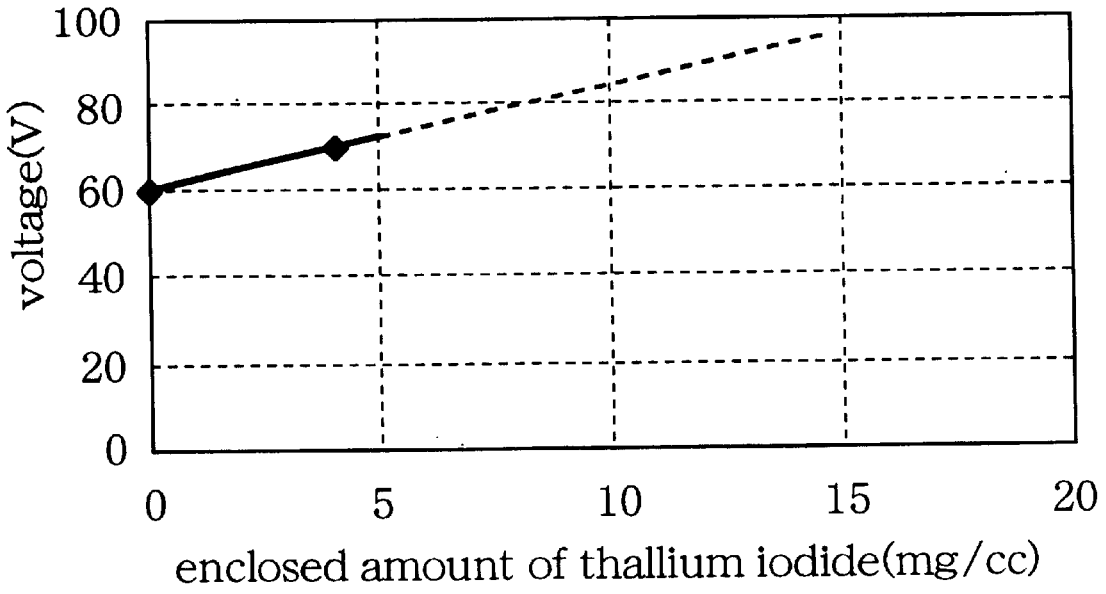
FIG. 11 is a graph showing a relation between the enclosed amount of thallium iodide and the lamp voltage in a mercury-free metal-halide lamp of Embodiment 4.

The notable fact of a mercury-free metal-halide lamp in Embodiment 4 is that the lamp is operated at a very high lamp voltage despite no mercury. FIG. 11 shows the changes of the lamp voltage in the case of operating at a lamp power of 35W like Embodiment 3 while changing the enclosed amount of thallium iodide (TlI). When thallium iodide (TlI) is added, the lamp voltage rises dramatically, and the more amount is added, the more the lamp voltage rises. For instance, the lamp voltage in the case of operating at a lamp power of 35W is approximately 70 V Thus, since a high lamp voltage is obtained, the lamp in Embodiment 4 can be operated for several hundred hours or more without the blackening of the arc tube, namely, any substantial change.

Since a high lamp voltage can be obtained as described above, it is possible to make current density a value below 20 $A/mm^2$ easily and to prolong the lamp life certainly, like a lamp in the above-mentioned Embodiment 3.

Figure 12:
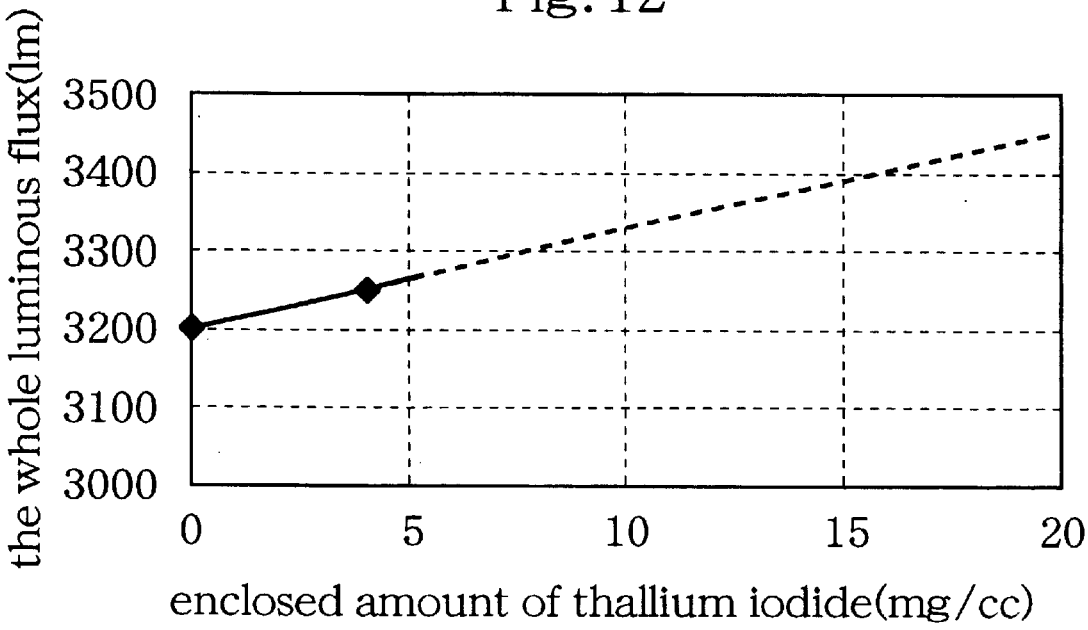
FIG. 12 is a graph showing a relation between the enclosed amount of thallium iodide and the whole luminous flux in a mercury-free metal-halide lamp of Embodiment 4.

The notable fact of the lamp in Embodiment 4 is that greatly much luminous flux of 3250 (1 m) can be obtained in the case of operating at a lamp power of 35W. FIG. 12 shows the changes of the luminous flux in the case of operating at a lamp power of 35W like Embodiment 3 while changing the enclosed amount of thallium iodide (TlI) enclosed in the lamp. As shown in FIG. 12, large luminous flux can be obtained by adding thallium iodide (TlI), and the more amount of thallium iodide is enclosed, the more the luminous flux increases.

An effect of a rise in the lamp voltage and an increase in the luminous flux by an increase in the enclosed amount of the above-mentioned thallium iodide (TlI) is obtained regardless of such other factors as the lamp power, a distance between the electrodes, an internal volume of the arc tube 1, the enclosed pressure of the Xe gas, the amount of scandium iodide and sodium iodide, and the kind and the amount of other halides enclosed with the thallium iodide.

Figure 13:
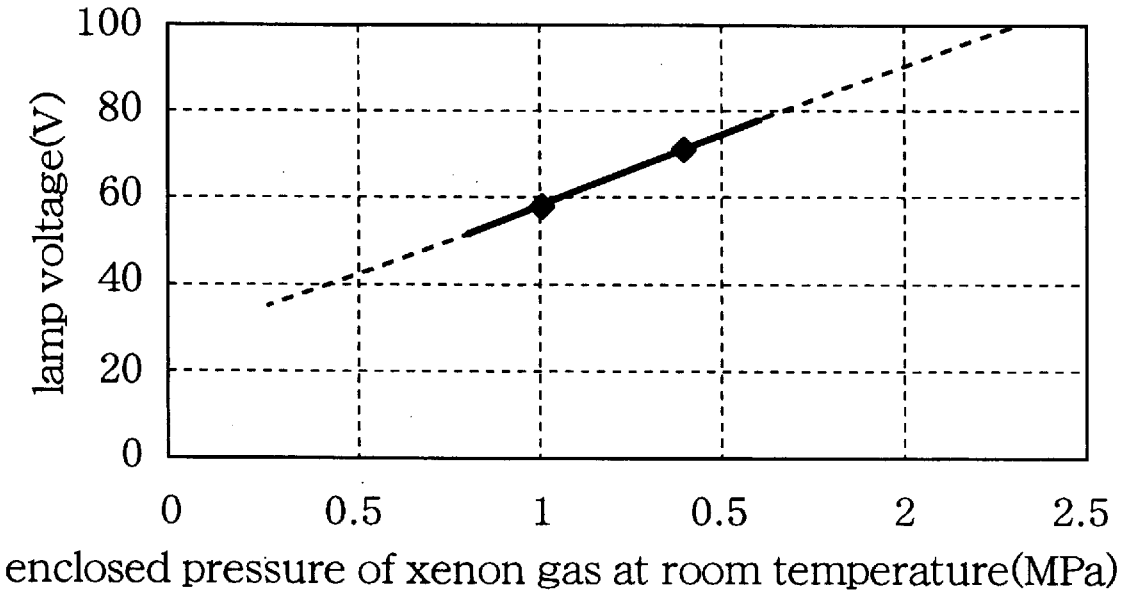
FIG. 13 is a graph showing a relation between the enclosed pressure of xenon gas and the lamp voltage in a mercury-free metal-halide lamp of Embodiment 4.
Figure 14:
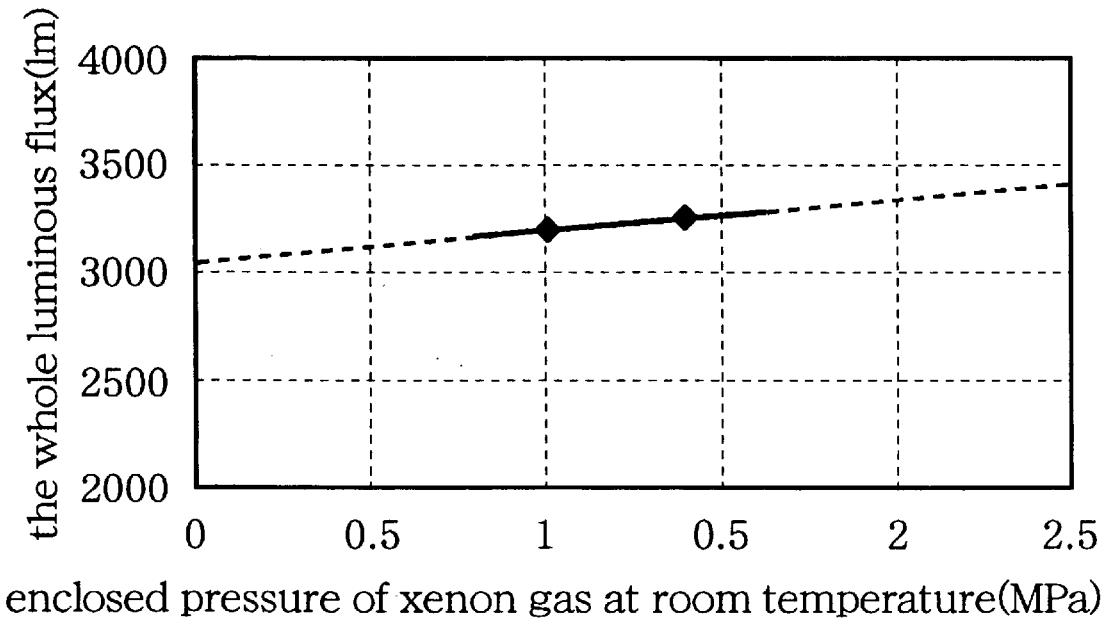
FIG. 14 is a graph showing a relation between the enclosed pressure of xenon gas and the whole luminous flux in a mercury-free metal-halide lamp of Embodiment 4.

Moreover, when the enclosed pressure of xenon (Xe) gas is increased, it is found that the lamp-voltage and the luminous flux increase further. FIGS. 13 and 14 show a relation between the enclosed pressure of Xe and the lamp voltage or the luminous flux in the case of operating at a lamp power of 35W. As shown in FIGS. 13 and 14, it is found that the more the enclosed pressure of Xe rises, the more the lamp voltage and the luminous flux rise. However, as described in Embodiment 3, it is desirable to determine the enclosed pressure of xenon gas at a value below 2.5MPa, more preferably, 2.0 MPa, as well as above approximately 5 to 20 kPa, more preferably, approximately 0.1MPa in terms of the maintenance of airtightness and an easy starting.

As described above, a mercury-free metal-halide lamp in Embodiment 4, wherein at least xenon gas, a trivalent of indium iodide ($InI_3$) and thallium iodide are enclosed in the arc tube 1, has such a characteristic that when the enclosed amount of thallium iodide is increased, the lamp voltage and the whole luminous flux increase as well as when the enclosed pressure of xenon gas is increased, the lamp voltage and the whole luminous flux increase. This effect is obtained regardless of such other factors as the lamp power, a distance between the electrodes, an internal volume of the arc tube 1, the amount of scandium iodide and sodium iodide, and the kind and the amount of other halides enclosed with the thallium iodide.

Accordingly, in a constitution of a mercury-free metal-halide lamp in Embodiment 4, when xenon gas with an appropriate pressure below an upper limit of 2.5MPa is enclosed and indium iodide, which is a trivalent of indium iodide, and thallium iodide are enclosed, it is possible to obtain a mercury-free metal-halide lamp most appropriate as a light source for motor vehicle headlights, wherein a high lamp voltage is obtained, and thereby the lamp has a long life; and more luminous flux than a halogen lamp occurs.

As regards a lamp power, like Embodiment 3, when a mercury-free lamp in Embodiment 4 is operated at a higher lamp power, more luminous flux is obtained. However, an upper limit of a consumption power of a mercury-free lamp in Embodiment 4 is actually approximately 55W if the lamp is used for motor vehicle headlights. The reason is that an operation in a range above a consumption power of a conventional halogen lamp is uneconomical and not preferable.

Like Embodiment 3, in a mercury-free metal-halide lamp in Embodiment 4, when xenon gas with an appropriate pressure below an upper limit of 2.5MPa is enclosed and a trivalent of indium iodide ($InI_3$) and thallium iodide with an appropriate amount below an upper limit of approximately 90.0 mg/cc per unit internal volume of the arc tube are enclosed, it is confirmed that the light color of a mercury-free lamp in Embodiment 4, in the case of operating at a lamp power of approximately 25 to 55W, is in a chromaticity range of the white light source specified in HID light sources for motor vehicle headlights (JEL215) by the Japan Electrical Lamp Manufacturers Association. That is, by means of determining the kind and the amount of the enclosures comprising a trivalent of indium iodide ($InI_3$) and a rated power as described above, a chromaticity coordinate of an emitted light of the lamp can be in a chromaticity range of the following equations in a CIE1931 x,y chromaticity diagram:

$x \geqq 0.310$, $x \leqq 0.500$, $y \leqq 0.150+0.640x$, $y \leqq 0.440$, $y \geqq 0.050+0.750x$, and $y \geqq 0.382$ (in the case where $x \geqq 0.44$). Accordingly, a mercury-free metal-halide lamp in Embodiment 4 is completely usable as a light source for motor vehicle headlights within the above-mentioned limited range of the enclosed pressure of xenon gas, the enclosed amount of a trivalent of indium iodide ($InI_3$), and a lamp power.

An example of a mercury-free lamp wherein thallium iodide is enclosed is described in the above-mentioned Embodiment 4, and instead of the thallium iodide, thallium bromide (TlBr) may be enclosed or thallium chloride (TlCl) may be enclosed. Furthermore, metal of thallium and halogen may be enclosed separately.

An example of a mercury-free lamp wherein a trivalent of indium iodide ($InI_3$) is enclosed is described in each of the Embodiments 3 and 4, and instead of the trivalent of indium iodide ($InI_3$), a trivalent of indium bromide ($InBr_3$) may be enclosed, or a trivalent of indium iodide ($InI_3$) and a trivalent of indium bromide ($InBr_3$) may be enclosed.

A trivalent of indium iodide ($InI_3$) may be enclosed in the arc tube 1 by separating into a monovalent of indium iodide (InI) and iodine $I_2$. Similarly, a trivalent of indium bromide ($InBr_3$) may be enclosed in the arc tube 1 by separating into a monovalent of indium bromide (InBr) and bromine $Br_2$. After enclosing a monovalent of indium iodide (InI) and bromine $Br_2$ in the arc tube 1, both trivalent of indium iodide ($InI_3$) and trivalent of indium bromide (InBr) may be produced in the arc tube 1. In addition, such halides as InI (or InBr) and AgI (or AgBr), wherein halogen separates easily at a high temperature, may be enclosed. That is, it is preferred that the enclosures comprise $InX_y$(X: iodine or bromine, y>1) substantially.

An example of a lamp comprising scandium iodide and sodium iodide besides xenon gas and a trivalent of indium iodide ($InI_3$) is described, and other halides of metal may be substituted for the scandium iodide and the sodium iodide.

For instance, scandium bromide may be substituted for the scandium iodide, and sodium bromide may be substituted for the sodium iodide. Furthermore, other metals such as thallium may be substituted for scandium and sodium. The enclosed amount of the halides of metal is not limited to the amount in the lamp of Embodiment 4.

In addition, the factors except a trivalent of indium halide and xenon gas, such as a distance between the electrodes, an internal volume of the arc tube 1, and the amount of scandium iodide and sodium iodide, are mere examples described in a mercury-free lamp in each of the Embodiments. For instance, a distance between the electrodes may be a value except 4.2 (mm), and an internal volume of the arc tube 1 is not limited to 0.025 (cc).

In the above-mentioned example, xenon gas with a pressure of approximately 0.7MPa or 1.4MPa at room temperature is enclosed in the arc tube 1 for the purpose of assisting the starting. Xenon gas is appropriate for rare gas in consideration of the utilization for motor vehicle headlights. In addition, rare gas except xenon gas such as argon gas may be used as the rare gas, and the enclosed pressure of rare gas is not limited to approximately 0.7MPa at room temperature.

Embodiment 5

A method of raising the lamp voltage by raising the vapor pressure of a metal halide after raising the temperature on a wall of the arc tube is described.

Figure 15:
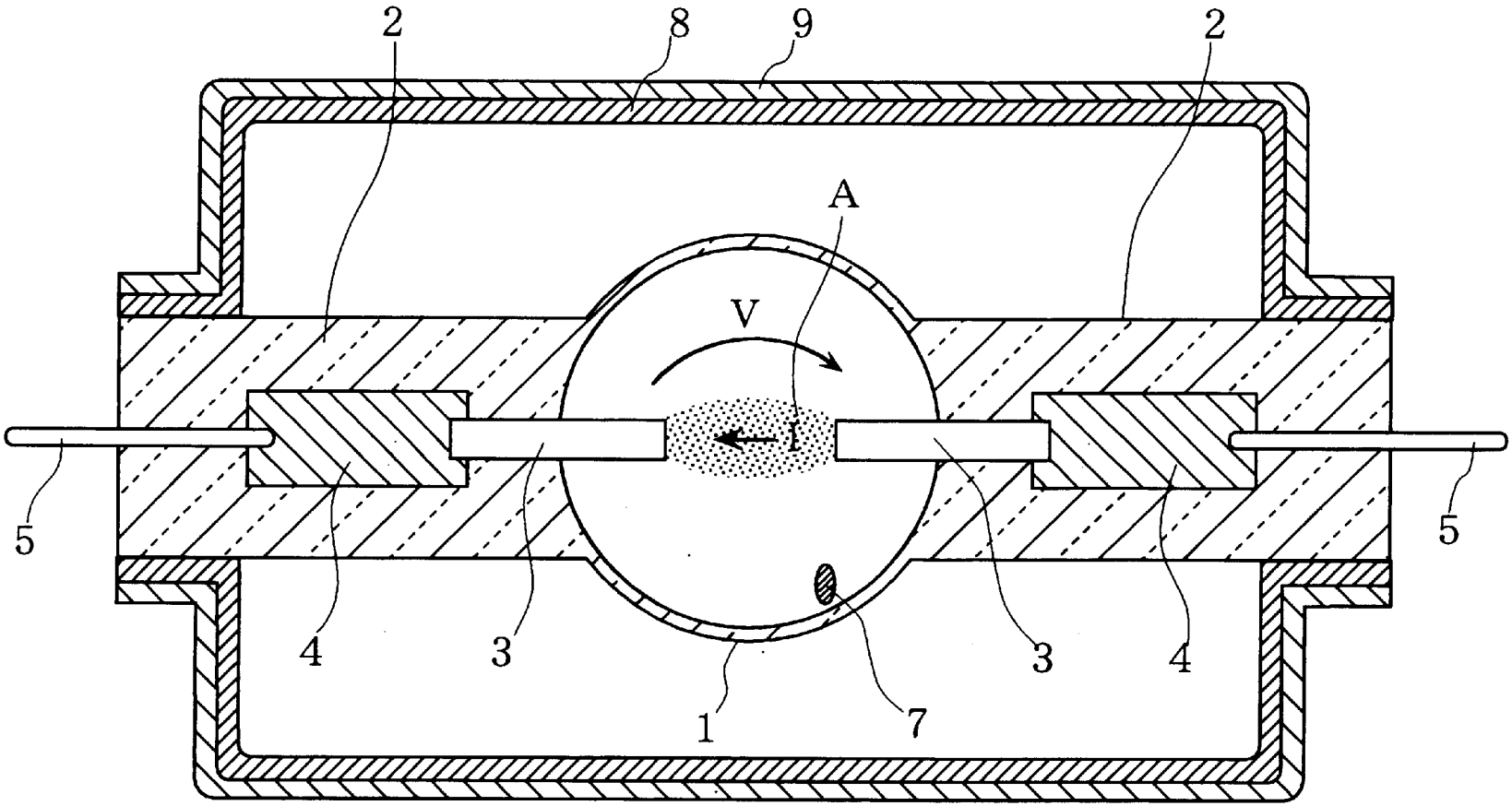
FIG. 15 is a cross sectional view showing a mercury-free metal-halide lamp in Embodiment 5 wherein a reflection film of infrared rays is coated.
Figure 16:
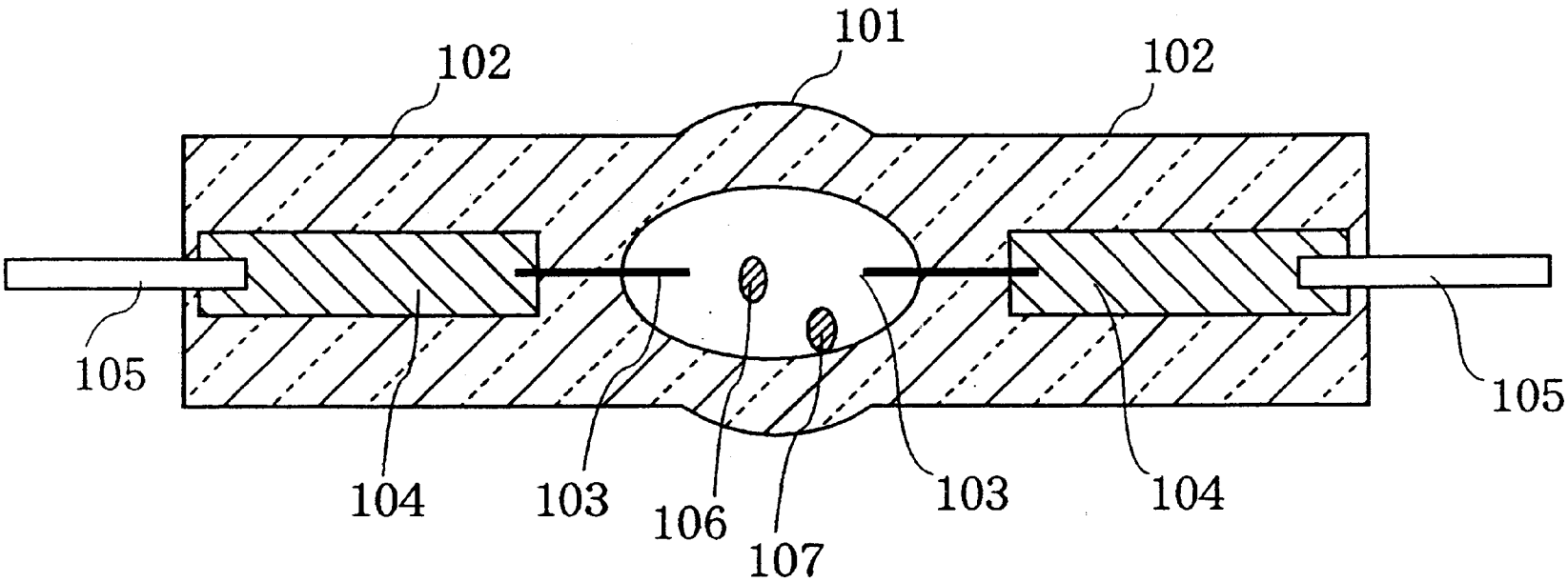
Fig. 16 Prior Art
FIG. 16 is a cross sectional view showing a conventional metal-halide lamp.

As shown in FIG. 15, the above-mentioned mercury-free metal-halide lamp in FIG. 1 is maintained in an external tube 8. A reflection film of infrared rays 9 is coated on the outside of the above-mentioned external tube 8. Consequently, since the heat retention is raised, the vapor pressure of a metal halide rises easily, and the lamp voltage can be raised easily. Accordingly, it is possible to make current density a low value and thereby to prolong the lamp life easily.

A film wherein TaOx film and SiOx film are coated in a multilayer by a thermal CVD method and a sputtering method is usable as the above-mentioned reflection film of infrared rays 9. It is preferred to determine the number of coated layers by tact time in manufacturing and a balance of manufacturing costs and lamp performance. For instance, if approximately eighteen layers or more are coated, an effect of a rise in the vapor pressure of a metal halide becomes notable. Furthermore, the reflection film of infrared rays 9 may be coated on the inside of the external tube 8 besides the outside.

Particularly preferable examples of the present invention are described in the above-mentioned Embodiments, and it goes without saying that such descriptions are not limited matters, but can have different variations. A mercury-free metal-halide lamp in Embodiments of the present invention is a mere example, and the limits of the present invention are determined by Claims.

INDUSTRIAL APPLICABILITY

As described above, according to the present invention, such an effect that a long lamp life can be obtained without causing a rise in the lamp voltage and the blackening of the arc tube 1 due to the evaporation of the electrodes while operation time becomes longer is produced by determining current density and the temperature at a tip of the electrodes below a predetermined value. Therefore, the present invention is serviceable in the field such as general luminaries and motor vehicle headlights.

What is claimed is:

1. A mercury-free metal-halide lamp comprising a pair of discharge electrodes in an arc tube; wherein:

at least a rare gas and a metal halide are enclosed in the arc tube; and I/S is 20 ($A/mm^2$) or less on a condition that an area of a cross section at a tip of said discharge electrodes is S ($mm^2$) and a lamp operating current is I (A).

2. A mercury-free metal-halide lamp according to claim 1, wherein said I/S is 15 ($A/mm^2$)or less.

3. A mercury-free metal-halide lamp according to claim 1, wherein a temperature at a tip of said discharge electrodes is 3200 K or less.

4. A mercury-free metal-halide lamp according to claim 3, wherein a temperature at a tip of said discharge electrodes is 2500 K or more.

5. A mercury-free metal-halide lamp according to claim 1, comprising at least one of a scandium halide and a sodium halide in said arc tube.

6. A mercury-free metal-halide lamp according to claim 5, comprising at least one of an indium halide and an yttrium halide in said arc tube.

7. A mercury-free metal-halide lamp according to claim 1, comprising at least a trivalent of indium halide in said arc tube.

8. A mercury-free metal-halide lamp according to claim 7, further comprising a thallium halide in said arc tube.

9. A mercury-free metal-halide lamp according to claim 7, further comprising at least one of a scandium halide and a sodium halide in said arc tube.

10. A mercury-free metal-halide lamp according to claim 8, further comprising at least one of a scandium halide and a sodium halide in said arc tube.

11. A mercury-free metal-halide lamp according to claim 7, wherein said trivalent of indium halide is at least one of iodide and bromide.

12. A mercury-free metal-halide lamp according to claim 1 comprising an external tube for maintaining said arc tube; wherein:

a reflection layer of an infrared ray is formed on said external tube.

* * * * *

UNITED STATES PATENT AND TRADEMARK OFFICE

CERTIFICATE OF CORRECTION

PATENT NO. : 6,653,801 B1
DATED : November 25, 2003
INVENTOR(S) : Mamoru Takeda et al.

It is certified that error appears in the above-identified patent and that said Letters Patent is hereby corrected as shown below:

Title page,
Item [30], Foreign Application Priority Data, "JP 54-142880 7/1989" change to -- JP 54-142880 7/1979 --.

Signed and Sealed this

Tenth Day of August, 2004

JON W. DUDAS
*Acting Director of the United States Patent and Trademark Office*